US007145523B2

(12) United States Patent
Hsu et al.

(10) Patent No.: US 7,145,523 B2
(45) Date of Patent: Dec. 5, 2006

(54) APPARATUS FOR DRIVING A PLASMA DISPLAY PANEL AND METHOD OF DRIVING THE SAME

(75) Inventors: Horng-Bin Hsu, Taipei (TW); Yi-Mei Li, Nantou County (TW); Jih-Fon Huang, Jubei (TW); Chem-Lin Chen, Shindian (TW)

(73) Assignee: AU Optronics Corp., Hsinchu (TW)

( * ) Notice: Subject to any disclaimer, the term of this patent is extended or adjusted under 35 U.S.C. 154(b) by 539 days.

(21) Appl. No.: 10/656,169

(22) Filed: Sep. 8, 2003

(65) Prior Publication Data

US 2004/0056827 A1 Mar. 25, 2004

(30) Foreign Application Priority Data

Sep. 23, 2002 (TW) ..... 91121713 A

(51) Int. Cl.
*G09G 3/28* (2006.01)

(52) U.S. Cl. ..... 345/60; 345/208; 315/169.4

(58) Field of Classification Search ..... 345/60–72; 315/169.4; *G09G 3/28*
See application file for complete search history.

(56) References Cited

U.S. PATENT DOCUMENTS 6,414,654 B1 * 7/2002 Makino ..... 345/60
6,819,055 B1 * 11/2004 Tessier ..... 315/169.1

FOREIGN PATENT DOCUMENTS

| | | | |
|---|---|---|---|
| CN | 1354451 | | 6/2002 |
| JP | 10171399 A | * | 6/1998 |
| JP | 2000-294144 | | 10/2000 |
| JP | 2003140598 A | * | 5/2003 |

* cited by examiner

*Primary Examiner*—Alexander Eisen
(74) *Attorney, Agent, or Firm*—Rabin & Berdo, P.C.

(57) ABSTRACT

A driving apparatus for driving a plasma display panel and a method of driving the same are disclosed. The plasma display panel includes multiple display cells, with each of the display cells comprising a sustain electrode, a scan electrode, and a data electrode. Every set of the electrodes has a corresponding driving circuit to provide a required driving waveform for driving the display cell to luminesce. The driving method includes the following steps: first, a first erase pulse, a priming pulse, and a second erase pulse are applied in sequence during a reset period. Then, data pulses corresponding to the display cells are applied during an address period. Lastly, multiple sustain pulses and multiple high frequency driving pulses are applied simultaneously during a sustain period.

19 Claims, 6 Drawing Sheets

APPARATUS FOR DRIVING A PLASMA DISPLAY PANEL AND METHOD OF DRIVING THE SAME

This application claims the benefit of Taiwan application Serial No. 91121713, filed on Sep. 23, 2002.

BACKGROUND OF THE INVENTION

1. Field of the Invention

The invention relates in general to a driving apparatus for driving a display and method of driving the same, and more particularly to a driving apparatus for driving a plasma display panel and method of driving the same.

2. Description of the Related Art

There is an increasing demand for better audio and video service in our daily lives. A conventional CRT (Cathode Ray Tube) display that requires an analog interface to create light and color will become an antiquated technology in the near future as digital TV is brought forth to mainstream broadcasting. A plasma display panel (PDP) with features such as large size, wide-angle viewing, high resolution, and full-color display function will replace the CRT display.

FIG. 1 is a perspective view showing a plasma display panel (PDP). The plasma display panel includes a front plate 102 and a rear plate 108. Multiple sustain electrodes X are parallel and are paired with multiple scan electrodes Y, respectively, which are on the surface of the front plate 102 opposite to the rear plate 108. The multiple sustain electrodes X and scan electrodes Y are covered by a dielectric layer 104. The dielectric layer 104 is covered by a protective film 106, which is made of MgO (magnesium oxide), to protect the multiple sustain electrodes X, scan electrodes Y, and the dielectric layer 104. In addition, multiple data electrodes (or called address electrodes) A are situated in parallel and are located on the rear plate 108 and are also covered by a dielectric layer 116. The multiple data electrodes A are perpendicular to the multiple sustain electrodes X and the multiple scan electrodes Y Multiple barrier ribs 112 are formed along the length of the rear plate 108 in parallel with the data electrodes A. Adjacent barrier ribs 112 and the rear plate 108 form a substantial U-shaped trench. A phosphor layer 110 is formed and is located between every two adjacent ribs 112.

The chamber sandwiched between the front plate 102 and the rear plate 108 is discharge space, which is filled with a discharge gas mixture of Ne (neon) and Xe (xenon). A display cell is defined by every pair of sustain electrodes X and scan electrode Y on the front plate 102 corresponding to the data electrodes A on the rear plate 108. Accordingly, multiple display cells are combined into a row-and-column matrix and are defined by the multiple sustain electrodes X, the scan electrodes Y, and the data electrodes A on the plasma display panel.

FIGS. 2A and 2B show a timing diagram of driving waveform for conventionally driving a display cell of the plasma display panel. The display cell displays a frame in each frame period. Each of the frame periods includes multiple subframe periods. A driving circuit applies a driving waveform to the display cell in every subframe period, which drives the display cell either to luminesce or not luminesce. Every subframe period can be divided into a three phase sequence: a reset period T1, an address period T2, and a sustain period T3. In the reset period T1, the scan electrodes Y first output an erase pulse $P_{Y1}$ to eliminate wall charges accumulated near the sustain electrodes X and the scan electrodes Y during the previous subframe period.

Afterwards, a priming pulse is applied to excite the discharge gases in the discharge space and enable ionization to again release discharge ions, which are needed for the display cell to luminesce, and also have the states of the active discharge ions of every display cell in the plasma display panel be identically excited. A manner of applying the priming pulse can be to have the sustain electrodes X output a high voltage to excite a pulse $P_{X2}$, as shown in FIG. 2A, or to have the sustain electrodes X and the scan electrodes Y, respectively, output pulses $P_{X2}$ and $P_{Y2}$ with opposite polarities, as shown in FIG. 2B. Furthermore, the priming pulse can be not only a square wave, but also a saw-tooth wave of the same waveform as the erase pulse $P_{Y1}$. Lastly, the driving circuit applies an erase pulse $P_{Y3}$ to the scan electrodes Y to eliminate wall charges in the display cell. In the address period T2, data pulses according to the image data are applied to data electrodes A to write wall charges into the display cells. In the sustain period T3, gas discharge occurs in the display cells with wall charge written in the address period T2 while alternating sustain pulses are applied to the sustain electrodes X and the scan electrodes Y, and also the discharge ions collide against each other constantly in the discharge space, so as to generate ultraviolet (UV) rays of the designated wavelength. The phosphor layer can emit visible light continually after absorbing the ultraviolet (UV) rays of the designated wavelength.

In comparison with other display models, such as the CRT (Cathode Ray Tube) display or the LCD (Liquid Crystal Display), a shortcoming of the plasma display panel is that the luminous and the luminance efficiency are inferior to other models. The critical problem that needs to be solved, then, is to determine how to enhance the luminous and the luminance efficiency of plasma display panels.

SUMMARY OF THE INVENTION

It is therefore an objective of the invention to provide a driving apparatus for driving a plasma display panel and method of driving the same, which can not only enhance the luminous and the luminance efficiency of the plasma display panel, but also enhance the display frame quality of the plasma display panel.

The invention achieves the above-identified objectives by providing a driving apparatus for driving a plasma display panel and method of driving the same. The plasma display panel includes a plurality of display cells, with each of the display cells including a sustain electrode, a scan electrode, and a data electrode. Each set of the sustain electrodes, scan electrodes, and data electrodes has a corresponding driving circuit to provide a required driving waveform for driving the display cell to luminesce. The driving method includes the following steps: first, a first erase pulse, a priming pulse, and a second erase pulse are applied in sequence during a reset period. Then, data pulses corresponding to the display cells are applied during an address period. Last, multiple sustain pulses and high frequency driving pulses are applied simultaneously during a sustain period.

Other objectives, features, and advantages of the invention will become apparent from the following detailed description of the preferred but non-limiting embodiments. The following description is made with reference to the accompanying drawings.

DETAILED DESCRIPTION OF THE INVENTION

Figure 1:
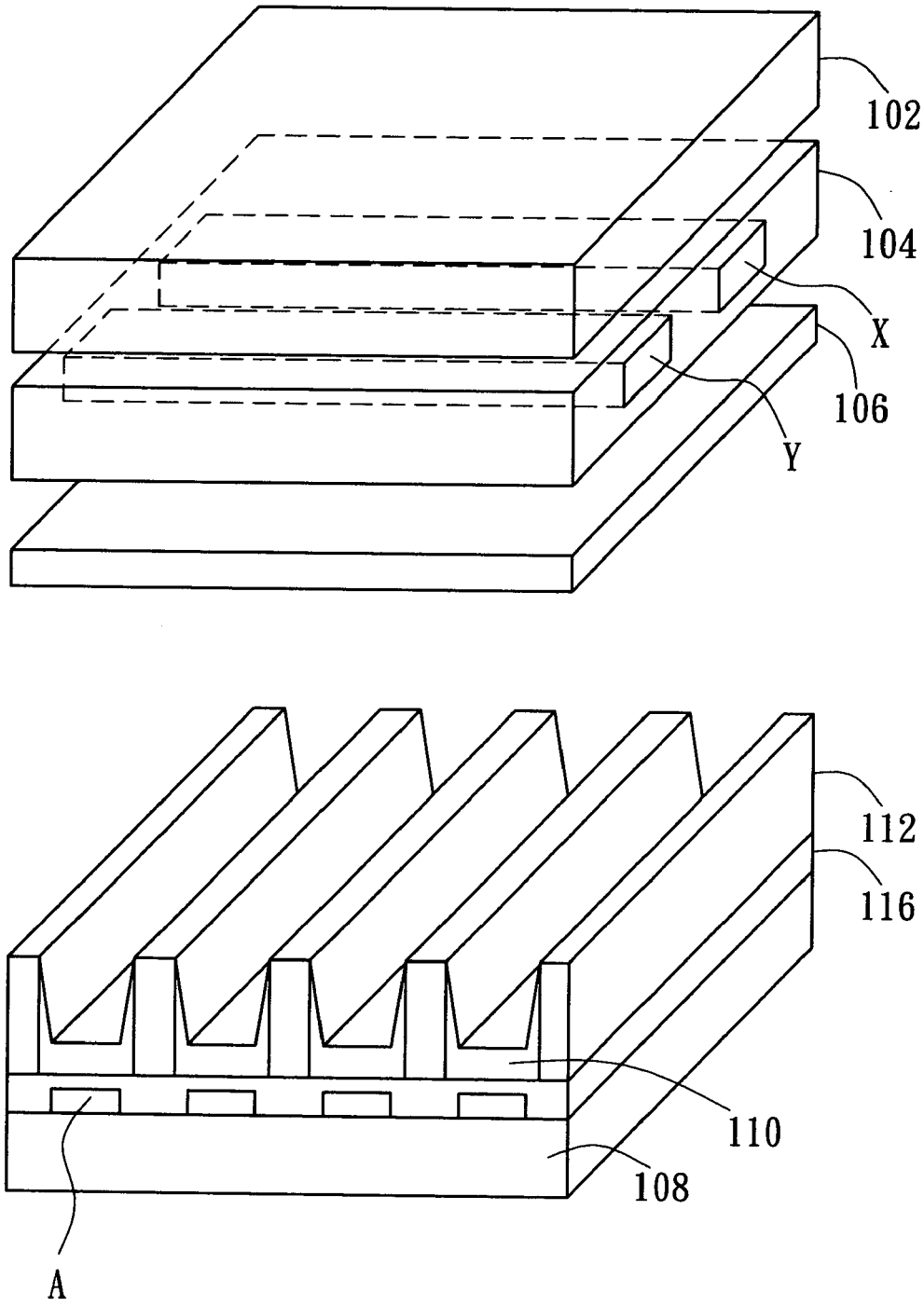
FIG. 1(PRIOR ART)
FIG. 1 (prior art) is a perspective view showing a conventional plasma display panel (PDP).
Figure 2A:
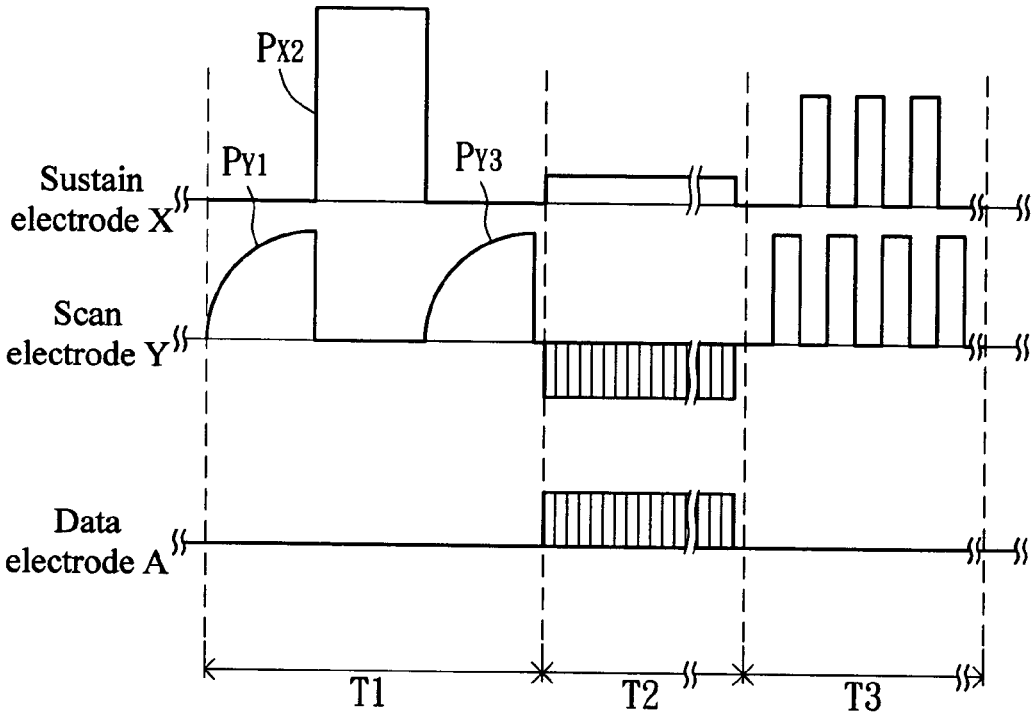
FIG. 2A(PRIOR ART)
FIGS. 2A and 2B (prior art) are timing diagrams illustrating conventional driving waveforms for driving a display cell of the plasma display panel.
Figure 2B:
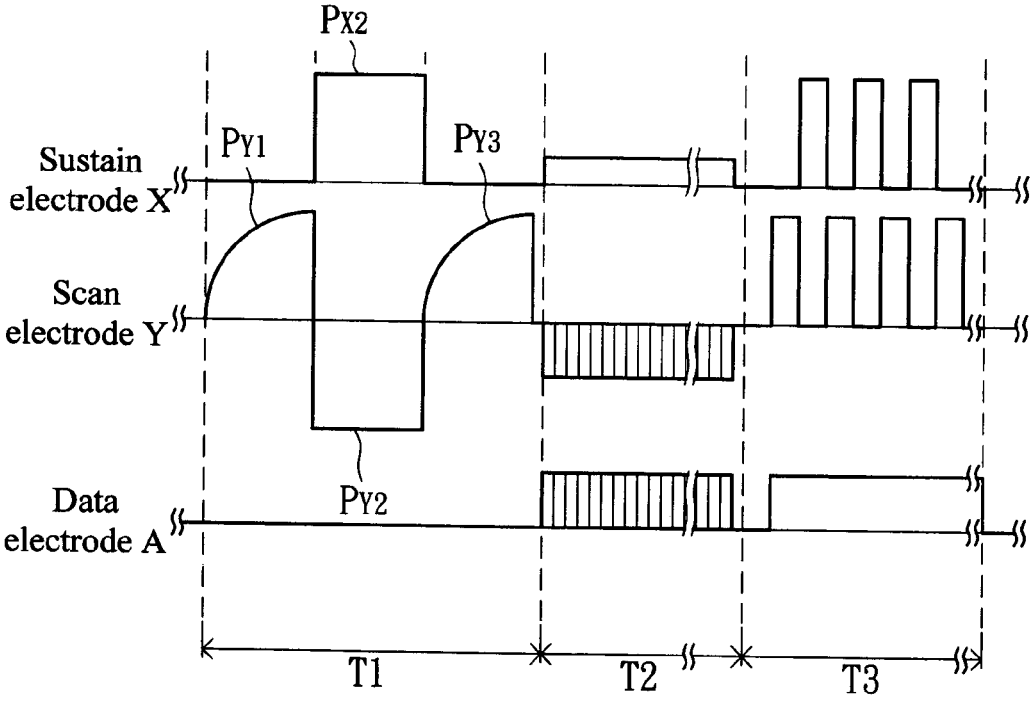
FIG. 2B(PRIOR ART)
Figure 3:
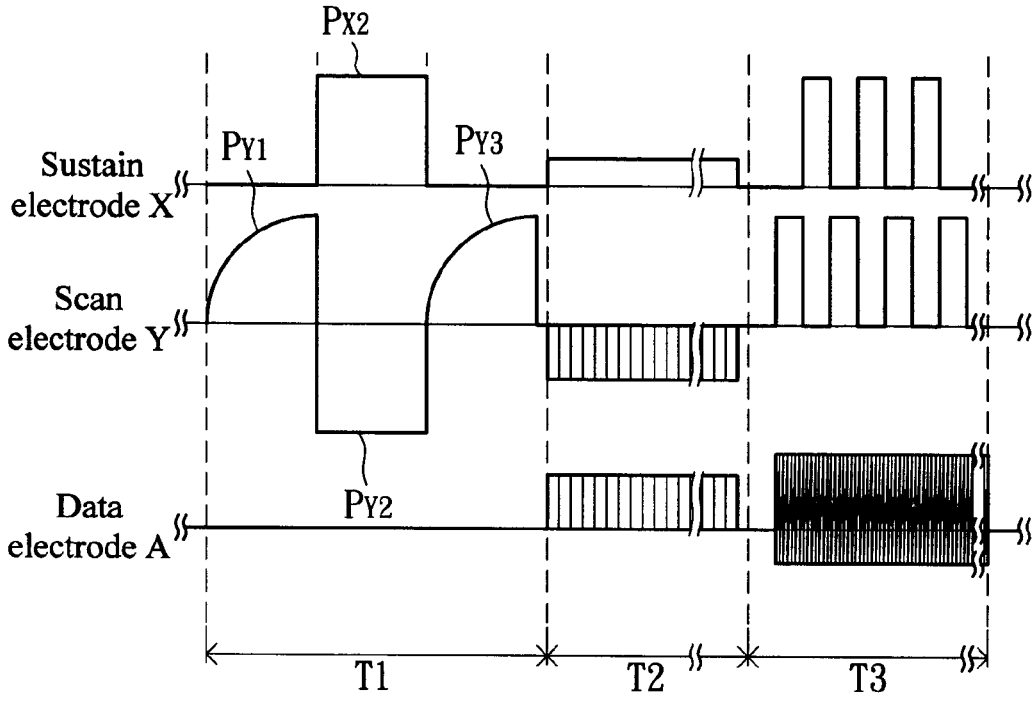
FIG. 3 shows a timing diagram of driving waveforms for driving the display cell according to a preferred embodiment of the invention.

Referring to FIGS. 2A, 2B, and 3, simultaneously, FIG. 3 shows a timing diagram of driving waveforms for driving the display cell according to a preferred embodiment of the invention. The greatest difference between the driving waveforms of the invention and the driving waveforms shown in the prior art is that high frequency driving pulses at a frequency of about 1 MHz or above will be continually applied to the data electrodes, while at the same time the sustain pulses is applied to the sustain electrodes X and the scan electrodes Y alternately during the sustain period.

Figure 4:
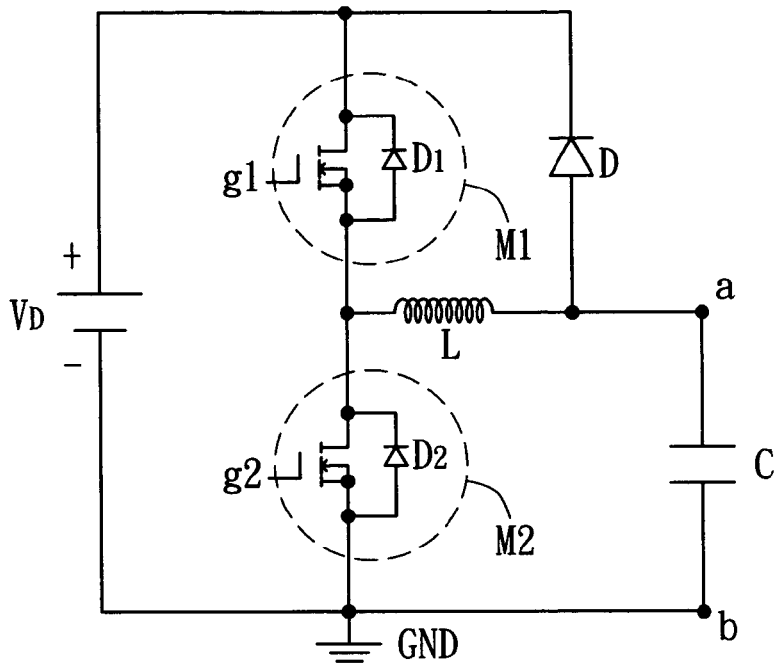
FIG. 4 illustrates a circuit diagram of a high-frequency driving pulse generator according to the preferred embodiment of the invention.

FIG. 4 shows a circuit diagram for a high-frequency driving pulse generator according to the preferred embodiment of the invention. The high-frequency driving pulse generator is coupled to the data electrodes, and is employed to apply the high frequency driving pulses to the data electrodes. The high-frequency driving pulse generator of the preferred embodiment includes a voltage source $V_D$, a first switch M1, a second switch M2, an inductor L, and a diode D. The voltage source $V_D$ supplies a direct current (D.C.) voltage, with a positive end connected to the first switch M1 and a negative end connected to ground GND. The first switch M1 and the second switch M2 are both n type metal oxide semiconductor field effect transistors (MOSFET). The drain electrode of the first switch M1 is connected to the voltage source $V_D$, while a source electrode is connected to the drain electrode of the second switch M2. The source electrode of the second switch M2 is connected to the ground GND. The diodes D1 and D2 are the body diodes of switches M1 and M2, respectively. The anode of the diode D is connected to the inductor L, while the cathode of the diode D is connected to the drain electrode of first switch M1. Also, one end of the inductor L is connected to both the source electrode of the first switch M1 and the drain electrode of the second switch M2, while the other end is connected to the anode of diode D.

The plasma display panel includes front and rear plates, and the electrodes are formed on the front and rear plates, thereby inducing an equivalent capacitance between the electrodes. In FIG. 4, this equivalent capacitance is represented by an equivalent capacitor C. The high-frequency driving pulse generator is coupled to the data electrodes of the rear plate at one node a, and to a ground of the display system of the plasma display panel at a node b.

Figure 5:
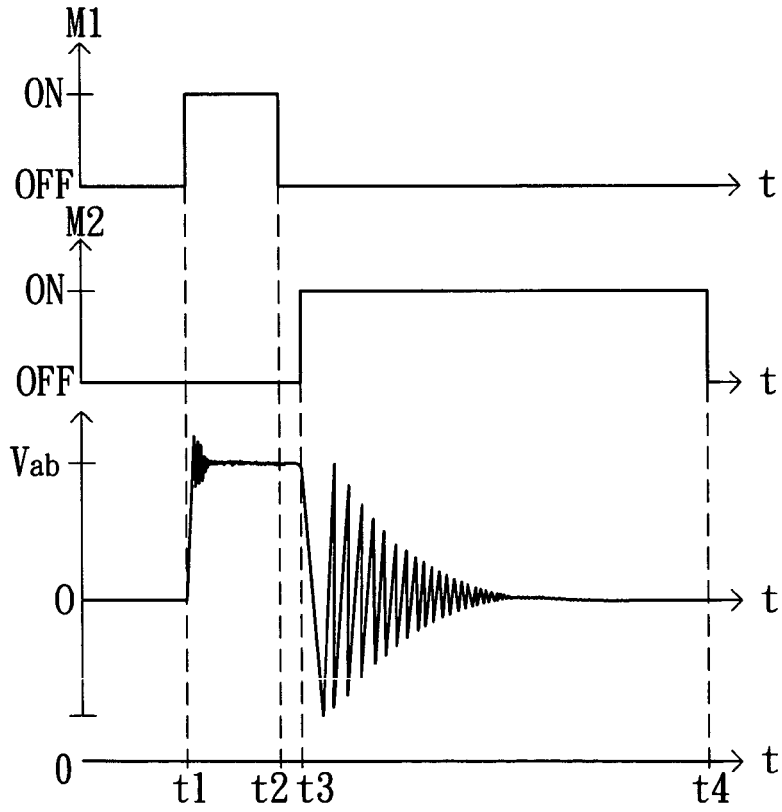
FIG. 5 shows a timing diagram of a control signal and an output signal from the high-frequency driving pulse generator provided by the preferred embodiment of the invention.
Figure 6A:
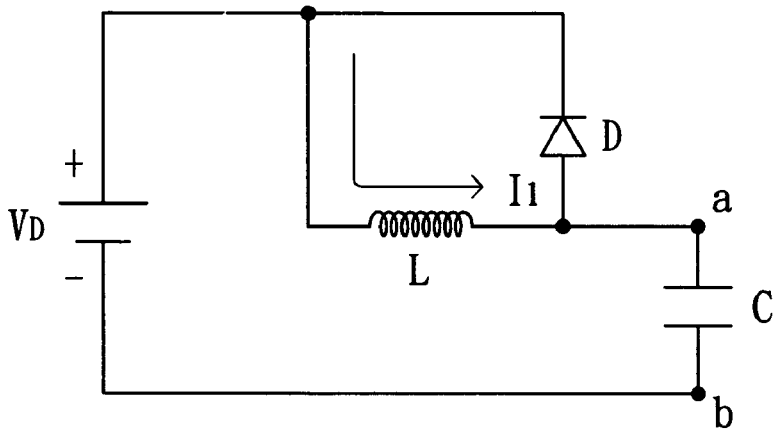
FIGS. 6A–6C show the equivalent circuit diagrams of the high-frequency driving pulse generator provided by the preferred embodiment according to the invention.

FIG. 5 shows a timing diagram for a control signal and an output waveform from the high-frequency driving pulse generator of the preferred embodiment. The high-frequency driving pulse generator controls its output signals by controlling the first switch M1 and the second switch M2 to be on and off. As shown in FIG. 5, the control method of the high-frequency driving pulse generator includes four steps, which are described in sequence, as follows:

1. $t1 \leqq t \leqq t2$:

Referring to FIG. 5, the first switch M1 is turned on and the second switch M2 is turned off when t=t1. An equivalent circuit representation of the high-frequency driving pulse generator is shown in FIG. 6A. When t=t1, the voltage on the equivalent capacitor C of the panel is 0V, and the inductor current $I_1$ flows from the voltage source $V_D$ through the inductor L to charge the equivalent capacitor C of the panel. The voltage on the equivalent capacitor C of the panel $V_{ab}$ begins to increase at this moment. When the voltage $V_{ab}$ is equal to a DC voltage value of the voltage source $V_D$, the diode D is forward biased. Therefore, the output voltage signal $V_{ab}$ is clamped at the DC voltage value output by the voltage source $V_D$, as shown in FIG. 5.

Figure 6B:
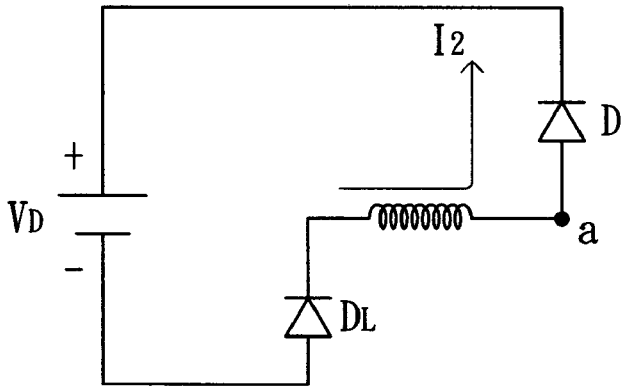

2. $t2 \leqq t \leqq t3$:

Referring to FIG. 5, the first switch M1 is turned off when t=t2. An equivalent circuit representation of the high-frequency driving pulse generator is shown in FIG. 6B. The direction of the inductor current $I_2$ in FIG. 6B is the same as that of the inductor current $I_1$ in FIG. 6A because of the continuity of the inductor current. The induced current $I_2$ from the inductor L flows through the diode D to the voltage source $V_D$. The output voltage signal $V_{ab}$ is still equal to the DC voltage value output by the voltage source $V_D$, as shown in FIG. 5.

Figure 6C:
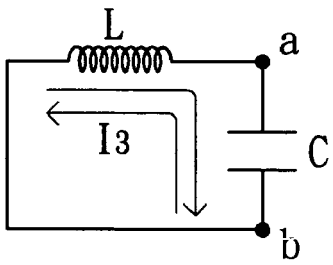

3. $t3 \leqq t \leqq t4$:

Referring to FIG. 5, the second switch M2 is turned on when t=t3. An equivalent circuit diagram of the high-frequency driving pulse generator is shown in FIG. 6C. The inductor L starts to resonate with the equivalent capacitor C of the panel. In this case, the voltage $V_{ab}$ starts to oscillate and the oscillating frequency is determined by the inductance value of the inductor L and the equivalent capacitance value of the equivalent capacitor C of the panel.

Due to the existence of inherent resistance, the equivalent circuit of the high-frequency driving pulse generator is not an ideal LC oscillating circuit. Consequently, the peak-to-peak value of the voltage $V_{ab}$ will decrease gradually, as shown in FIG. 5.

In FIG. 5, the average value of the voltage $V_{ab}$ is zero, and the maximum peak value of the voltage $V_{ab}$ is equal to the DC voltage value of the voltage source $V_D$; however, the invention is not limited thereto. The invention can also be achieved by adding a DC bias circuit to the high-frequency driving pulse generator so that the average value of the output voltage signal $V_{ab}$ is a non-zero DC bias voltage, for example, equal to the DC voltage value of the voltage source $V_D$.

4. $t4 \leqq t$:

Referring to FIG. 5, the second switch M2 is turned off when t=t4. At this time, the first and second switches M1 and M2 are off, and the value of the output voltage signal $V_{ab}$ is zero.

Figure 7:
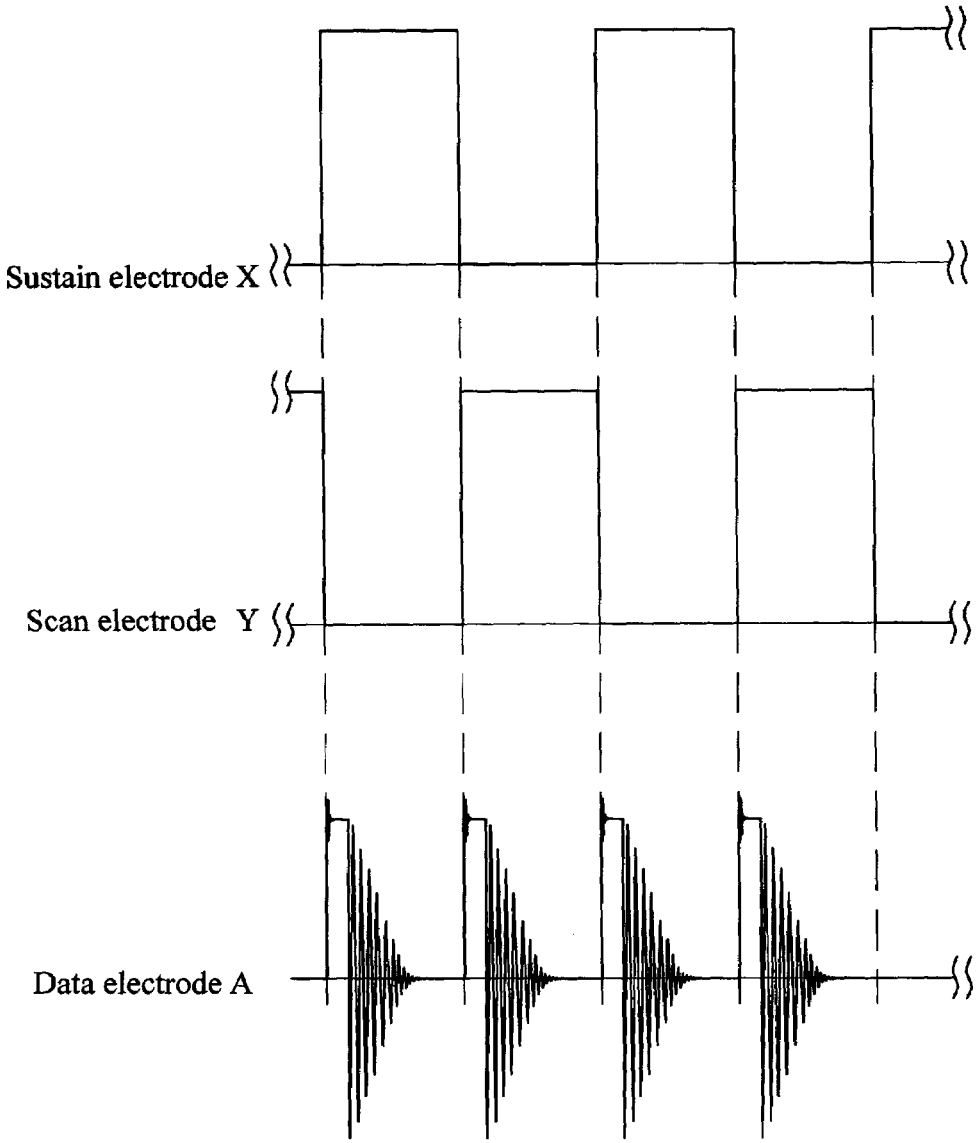
FIG. 7 shows a timing diagram illustrating driving signals during sustain period according to the preferred embodiment of the invention.

FIG. 7 shows a timing diagram of driving waveforms during the sustain period according to the preferred embodiment of the invention. The high-frequency driving pulse generator is coupled to the data electrode A. The first switch M1 of the high-frequency driving pulse generator is turned on so as to apply a pulse with steep slope to the data electrode A to output a pulse signal with while the sustain pulse is applied to the sustain electrode X or the scan electrode Y. Then the second switch M2 is turned on and the first switch M1 is turned off, and the high-frequency driving pulse generator applies high frequency driving pulses to the data electrode A. The high frequency driving pulses will influence the motion of the discharge ions in the discharge space by repel or attract the discharge ions so as to increase the probability of collision between the discharge ions. It will help to excite the discharge gas in the discharge space of the display cell and generate more ultraviolet (UV) to excite the phosphor in the phosphor layer so that more visible light is emitted. In addition to the above process to increase the amount of UV rays produced by the collisions between excited ions, UV rays of specifically designated wavelengths can also be produced through control of the peak-to-peak value and frequency of the high frequency driving pulses, thereby more effectively producing visible light through the phosphors in the phosphor layer to absorb the UV rays. Therefore, in comparison with the method of the prior art, the driving signal for driving the display cell of the plasma display panel according to the invention not only can enhance the luminance and the luminance efficiency of the plasma display panel but also can enhance the display quality of the plasma display panel.

The driving apparatus for driving a plasma display panel and method of driving the same according to the above-mentioned embodiments of the invention can enhance the effect of the luminance and the luminance efficiency of the plasma display panel. It can also enhance the display quality of the plasma display panel.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A method for driving a plasma display panel, wherein the plasma display panel comprises a plurality of display cells, with each of the display cells comprising a sustain electrode, a scan electrode, and a data electrode, wherein each set of the sustain electrodes, scan electrodes, and data electrodes has a corresponding driving circuit to provide a required driving waveform for driving the display cell to luminesce, wherein the method includes the steps of:

applying a first erase pulse;

applying a priming pulse;

applying a second erase pulse;

applying data pulses, wherein the data pulses correspond to the display cell; and applying a plurality of sustain pulses and a plurality of high frequency driving pulses, wherein the high frequency driving pulses are output by the data electrodes.

2. The driving method according to claim 1, wherein the first erase pulse and the second erase pulse are output by the scan electrodes.

3. The driving method according to claim 1, wherein the priming pulse is output by the sustain electrodes and the scan electrodes, respectively.

4. The driving method according to claim 3, wherein the priming pulse output by the sustain electrodes and the priming pulse output by the scan electrodes are of opposite polarity.

5. The driving method according to claim 1, wherein the data pulses are output by the data electrode.

6. The driving method according to claim 1, wherein the sustain pulses are output by the sustain electrodes and the scan electrodes alternately.

7. A driving apparatus installed in a plasma display panel, wherein the plasma display panel comprises a plurality of display cells, with each of the display cells comprising the driving apparatus for driving the display cell to luminesce, wherein the driving apparatus comprises:

a sustain electrode for outputting a plurality of sustain pulses;

a scan electrode for outputting a plurality of erase pulses and a plurality of sustain pulses; and a data electrode for outputting data pulses and a plurality of high frequency driving pulses;

wherein the data electrode outputs the high frequency driving pulses at the same time while the sustain electrode and the scan electrode output the sustain pulses.

8. The driving apparatus according to claim 7, wherein the data electrode is coupled to a high-frequency driving pulse generator, wherein the high-frequency driving pulse generator comprises:

a voltage source for providing a direct current voltage signal;

a first switch coupled to the voltage source;

a second switch coupled to the first switch and also coupled to the voltage source at a second node;

a diode coupled to the first switch; and an inductor coupled to the first switch and the second switch, respectively, and also coupled to the diode at a first node;

wherein the high-frequency driving pulse generator applies a plurality of high frequency driving pulses to the data electrode.

9. The driving apparatus according to claim 8, wherein the plasma display panel further includes front and rear plates, wherein the high-frequency driving pulse generator is coupled to a data electrode of the rear plate at the first node and is also coupled to a ground at the second node.

10. The driving apparatus according to claim 8, wherein a positive end of the voltage source is coupled to the first switch, and a negative end of the voltage source is coupled to the second switch.

11. The driving apparatus according to claim 8, wherein a drain electrode of the first switch is coupled to the voltage source, and a source electrode of the first switch is coupled to the second switch.

12. The driving apparatus according to claim 8, wherein a drain electrode of the second switch is coupled to the first switch, and a source electrode of the second switch is coupled to the voltage source.

13. The driving apparatus according to claim 8, wherein the first switch comprises a body diode, wherein an anode of the body diode is coupled to a source electrode of the first switch, and a cathode of the body diode is coupled to a drain electrode of the first switch.

14. The driving apparatus according to claim 8, wherein the second switch comprises a body diode, wherein an anode of the body diode is coupled to a source electrode of the second switch, and a cathode of the body diode is coupled to a drain electrode of the second switch.

15. The driving apparatus according to claim 8, wherein an anode of the diode is coupled to the inductor, and a cathode of the diode is coupled to the first switch.

16. The driving apparatus according to claim 8, wherein a method for controlling the high-frequency driving pulse generator includes the following steps:

turning on the first switch;

turning off the first switch;

turning on the second switch; and turning off the second switch;

wherein the high-frequency driving pulse generator outputs a voltage signal; the signal increases over time and has a maximum value equal to the direct current voltage signal when the first switch is on; and the voltage signal is a high frequency driving pulse when the first switch is off and the second switch is on.

17. The driving apparatus according to claim 16, wherein a peak-to-peak value of the high frequency driving pulse decreases over time when the second switch is on.

18. The driving apparatus according to claim 17, wherein a peak value of the high frequency driving pulse is equal to the direct current voltage signal in magnitude.

19. The driving apparatus according to claim 16, wherein the high-frequency driving pulse generator outputs the voltage signal from the first and second nodes.

* * * * *